US008599122B2

(12) United States Patent
Shin et al.

(10) Patent No.: US 8,599,122 B2
(45) Date of Patent: Dec. 3, 2013

(54) DISPLAY DEVICE TO COMPENSATE A KICKBACK VOLTAGE AND METHOD OF DRIVING THE SAME

(75) Inventors: Kyoung-Ju Shin, Hwaseong-si (KR); Jun-Hyung Souk, Yongin-si (KR); Chong-Chul Chai, Seoul (KR)

(73) Assignee: Samsung Display Co., Ltd. (KR)

( * ) Notice: Subject to any disclaimer, the term of this patent is extended or adjusted under 35 U.S.C. 154(b) by 948 days.

(21) Appl. No.: 12/069,968

(22) Filed: Feb. 13, 2008

(65) Prior Publication Data

US 2008/0198122 A1 Aug. 21, 2008

(30) Foreign Application Priority Data

Feb. 15, 2007 (KR) ..... 10-2007-0016226

(51) Int. Cl.
*G09G 3/36* (2006.01)

(52) U.S. Cl.
USPC ..... 345/94

(58) Field of Classification Search
USPC ..... 345/94
See application file for complete search history.

(56) References Cited

U.S. PATENT DOCUMENTS

| | | | | |
|---|---|---|---|---|
| 5,625,387 | A * | 4/1997 | Moon | 345/211 |
| 6,388,648 | B1 * | 5/2002 | Clifton et al. | 345/88 |
| 2001/0024199 | A1 | 9/2001 | Hughes et al. | |
| 2004/0169629 | A1 * | 9/2004 | Lee et al. | 345/95 |
| 2005/0122301 | A1 * | 6/2005 | Song | 345/96 |
| 2006/0158415 | A1 * | 7/2006 | Izumi | 345/98 |
| 2007/0013635 | A1 * | 1/2007 | Ito et al. | 345/98 |
| 2007/0103420 | A1 * | 5/2007 | Chao et al. | 345/98 |

FOREIGN PATENT DOCUMENTS

| | | |
|---|---|---|
| KR | 10-0136966 | 2/1998 |
| KR | 10-2003-0078142 | 10/2003 |
| KR | 10-2004-0053641 | 6/2004 |
| KR | 10-2005-0113477 | 12/2005 |
| KR | 10-2006-0029367 | 4/2006 |
| KR | 10-2006-0099663 | 9/2006 |

OTHER PUBLICATIONS

Korean Patent Abstracts, Publication No. 1020050113477, Dec. 2, 2005, 1 p.
Korean Patent Abstracts, Publication No. 1020060029367, Apr. 6, 2006, 1 p.
Korean Patent Abstracts, Publication No. 1020060099663, Sep. 20, 2006, 1 p.

* cited by examiner

*Primary Examiner* — Chanh Nguyen
*Assistant Examiner* — John Kirkpatrick
(74) *Attorney, Agent, or Firm* — Innovation Counsel LLP

(57) ABSTRACT

A display device includes a gate driving part, a data driving part, a display panel and a kickback voltage compensating part. The gate driving part outputs a gate signal, and the data driving part outputs a data signal. The display panel displays an image in response to the gate signal and the data signal. A pixel voltage of the display panel is reduced by a kickback voltage varied based on a gray scale and induced when the gate signal falls. The kickback voltage compensating part compensates an image control signal externally provided to the kickback voltage compensating part for the kickback voltage to output a data control signal to the data driving part.

20 Claims, 9 Drawing Sheets

DISPLAY DEVICE TO COMPENSATE A KICKBACK VOLTAGE AND METHOD OF DRIVING THE SAME

CROSS-REFERENCE TO RELATED APPLICATIONS

This application claims priority under 35 USC §119 to Korean Patent Application No. 10-2007-16226, filed on Feb. 15, 2007 in the Korean Intellectual Property Office (KIPO), the contents of which are herein incorporated by reference in their entirety.

BACKGROUND OF THE INVENTION

1. Field of the Invention

The present invention relates to a display device and a method of driving the display device. More particularly, the present invention relates to a display device capable of increasing light transmittance and a method of driving the display device.

2. Description of the Related Art

In general, a liquid crystal display (LCD) apparatus has desirable characteristics such as light weight, low power consumption, and low driving voltage, in comparison with other types of display devices such as a cathode ray tube, and a plasma display panel (PDP). Thus, the LCD apparatus is used in various fields, for example, monitors, notebook computers, and mobile phones.

The LCD apparatus typically includes an LCD panel, a backlight unit disposed under the LCD panel and a driving unit connected to the LCD panel. The LCD panel displays an image using optical and electrical properties of liquid crystal, such as an anisotropic refractive index, and an anisotropic dielectric constant. The backlight unit provides the LCD panel with light. The driving unit controls the LCD panel. The LCD panel includes an array substrate, an opposing substrate facing the array substrate and a liquid crystal layer interposed between the array substrate and the opposing substrate.

The array substrate includes gate lines which extend in a first direction, data lines which extend in a second direction substantially perpendicular to the first direction, a thin-film transistors (TFT) connected to the gate lines and the data lines, a pixel electrode connected to the TFT and a storage line which overlaps with the pixel electrodes. Each pixel electrode is formed in a pixel area defined by the gate line and data line. The storage line maintains a pixel voltage, with which the pixel electrode is charged, for one frame.

Processes for charging the pixel electrode with the pixel voltage are as follows. When a gate signal is applied to the gate line rises, a channel in the TFT is opened. A data signal applied to the data line is provided to the pixel electrode through the channel to charge the pixel electrode with the pixel voltage. When the gate signal falls, the channel is closed so that the pixel voltage is maintained in one frame.

When the gate signal falls, the pixel voltage is reduced by a gate-source capacitor generated by a gate electrode and a source electrode, which overlap with each other. A voltage value, by which the pixel voltage is reduced, is referred to as a kickback voltage. The kickback voltage is varied based on a gray scale voltage of the data signal. For example, a white common voltage corresponding to a white gray scale is different from a black common voltage corresponding to a black gray scale.

When the white common voltage is different from the black common voltage, the LCD panel may display an image defect known as flicker. In order to prevent and/or reduce the defects, the pixel electrode and the storage line may be designed such that a region, in which the pixel electrode and the storage line overlap with each other, is increased. However, the size of the overlap region is increased, the light transmittance of the LCD panel may be reduced by as much as the size increase of the overlap region.

SUMMARY OF THE INVENTION

The present invention provides a display device capable of preventing and/or reducing flicker defects and improving light transmittance.

The present invention also provides a method of driving the above-mentioned display device.

In embodiment of the present invention, a display device includes a gate driving part, a data driving part, a display panel and a kickback voltage compensating part.

The gate driving part outputs a gate signal, and the data driving part outputs a data signal. The display panel displays an image in response to the gate signal and the data signal. A pixel voltage of the display panel is reduced by a kickback voltage varied based on a gray scale and induced when the gate signal falls. The kickback voltage compensating part compensates an image control signal externally provided to the kickback voltage compensating part for the kickback voltage to output a data control signal to the data driving part.

For example, the image control signal and the data control signal may be digital signals, and the gate signal and the data signal may be analog signals. Furthermore, the data control signal may have data corresponding to an entire range including a positive polarity and a negative polarity of the data signal.

For example, the kickback voltage compensating part may include a kickback voltage look-up memory in which data corresponding to the kickback voltage is stored. The kickback voltage may have data varying based on a level of the data signal.

In embodiment of present invention, there is provided a method of driving a display device. A pixel voltage of the display device is reduced by a kickback voltage varied based on a gray scale and induced when the gate signal falls. The display device receives an image control signal from the external source. The display device compensates the image control signal for the kickback voltage to generate a data control signal. The display device displays an image in response to the data control signal.

According to the above, a data driving part is provided with a data control signal generated compensating an image control signal for a kickback voltage to display an image. Thus, flicker defects may be reduced and/or prevented. Furthermore, the light transmittance of the display device may be improved.

BRIEF DESCRIPTION OF THE DRAWINGS

The above and other advantages of the present invention will become readily apparent by reference to the following detailed description when considered in conjunction with the accompanying drawings wherein.

DESCRIPTION OF THE EMBODIMENTS

Figure 1:
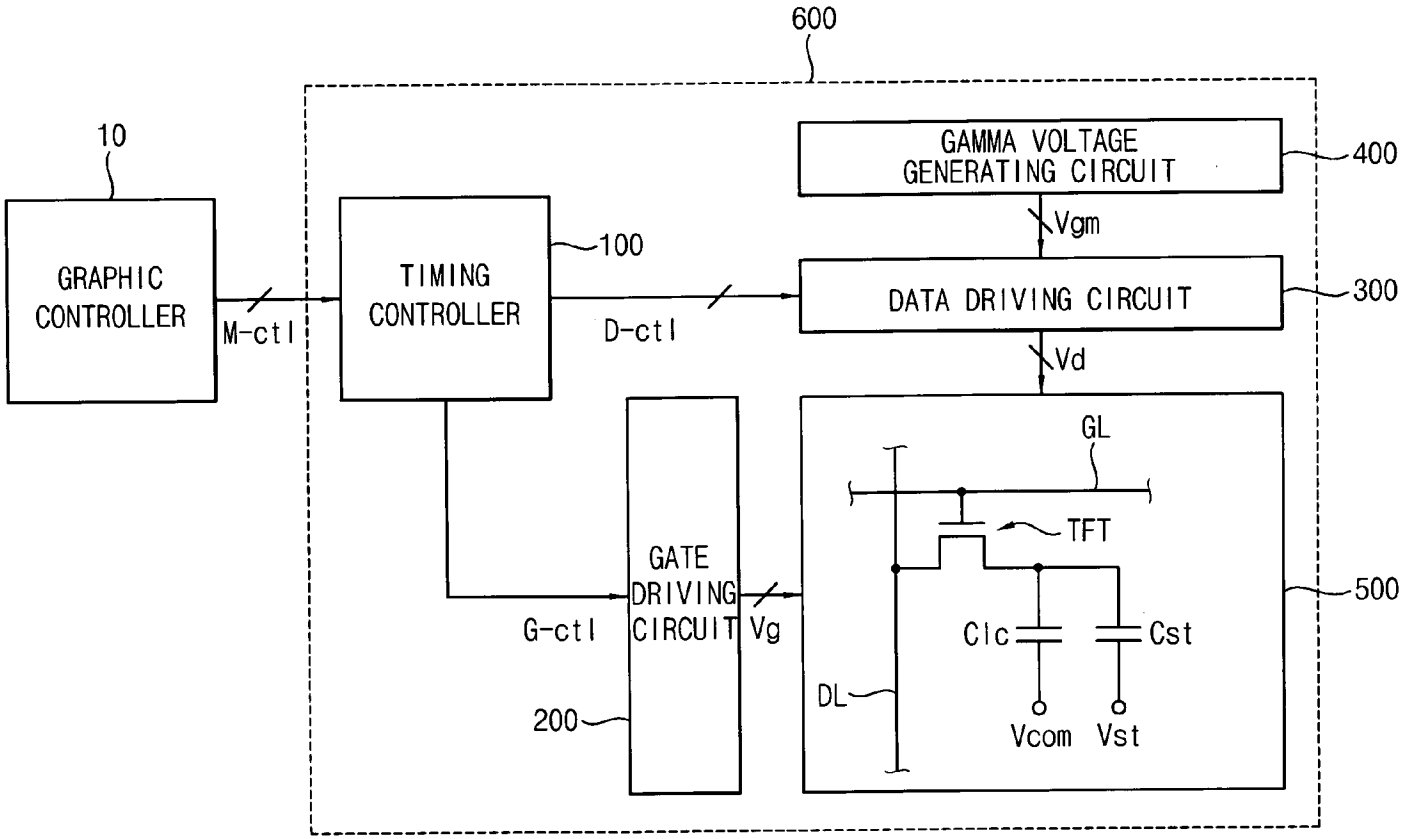
FIG. 1 is a block diagram illustrating a display device according to an embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, when the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display device according to an embodiment of the present invention.

Referring to FIG. 1, a display device 600 includes a timing controller 100, a gate driving part 200, a data driving part 300, a gamma voltage generating part 400 and a display device 500.

The timing controller 100 controls the gate driving part 200 and the data driving part 300 in response to an image control signal M-ctl provided by an external graphic controller 10. For example, the timing controller 100 outputs a gate control signal G-ctl to control the gate driving part 200 and a data control signal D-ctl to control the data driving part 300 in response to the image control signal M-ctl. Each of the image control signal M-ctl, the gate control signal G-ctl and the data control signal D-ctl may be a digital signal.

The data control signal D-ctl provided by the timing controller 100 includes data compensating for a kickback voltage of a display panel 500. The data control signal D-ctl and the kickback voltage are described more fully later.

The gate driving part 200 outputs a gate signal Vg to the display panel 500 in response to the gate control signal G-ctl provided by the timing controller 100. The gate signal Vg may be an analog signal having a gate voltage to practically drive the display panel 500.

The data driving part 300 outputs a data signal Vd to the display panel 500 in response to the data control signal D-ctl provided by the timing controller 100. The data signal Vd may be an analog signal having a data voltage to practically drive the display panel 500.

The gamma voltage generating part 400 provides the data driving part 300 with a plurality of gamma voltages Vgm. When the gamma voltage generating part 400 provides the data driving part 300 with the gamma voltages Vgm, the data driving part 300 selects one of the gamma voltages Vgm corresponding to the data control signal D-ctl, and outputs the data signal Vd to the display panel 500.

Alternatively, the gamma voltage generating part 400 may be externally provided with a first gamma voltage, and then output a plurality of second gamma voltages segmented compared to the first gamma voltage by using resistance heat levels different from each other.

The display panel 500 is provided with the gate signal Vg by the gate driving part 200, and is provided with the data signal Vd by the data driving part 300. The display panel 500 displays an image in response to the gate signal Vg and the data signal Vd.

For example, the display panel may include an array substrate (not shown), an opposing substrate (not shown) facing the array substrate, a liquid crystal layer (not shown) interposed between the array substrate and the opposing substrate.

The array substrate includes a gate line GL, a data line DL, a thin-film transistor (TFT) and a pixel electrode (not shown), and may further include a storage line (not shown).

The gate line GL extends in a first direction, and is provided with the gate signal Vg. The data line DL extends in a second direction substantially perpendicular to the first direction, and is provided with the data signal Vd. The gate line GL and the data line DL crosses each other so that a pixel area (not shown) is defined. The TFT is connected to the gate line GL and the data line DL, and is provided with the gate signal Vg and the data signal Vd.

The pixel electrode is formed in the pixel area, and is connected to the TFT. Thus, the pixel electrode is charged with a pixel voltage by the TFT. The pixel voltage charged in the pixel electrode is reduced by the kickback voltage when the gate signal Vg falls. This is described more fully below.

The storage line is overlapped with the pixel electrode to maintain the pixel voltage for one frame. For example, the storage line may be provided with a storage voltage Vst, and may be formed from substantially the same layer as the gate line GL.

For example, the opposing substrate may include a light-blocking layer (not shown), a color filter (not shown) and a common electrode (not shown). The light-blocking layer may overlap with the gate line GL, the data line DL and the TFT. The color filter covers the light-blocking layer and overlaps with the pixel electrode. The common electrode is formed on the color filter, and is provided with a common voltage Vcom. The common voltage Vcom and the storage voltage Vst may have substantially the same voltage values.

A liquid crystal capacitor Clc is defined between the pixel electrode and the common electrode, and a storage capacitor Cst is defined between the pixel electrode and the storage line.

Figure 2:
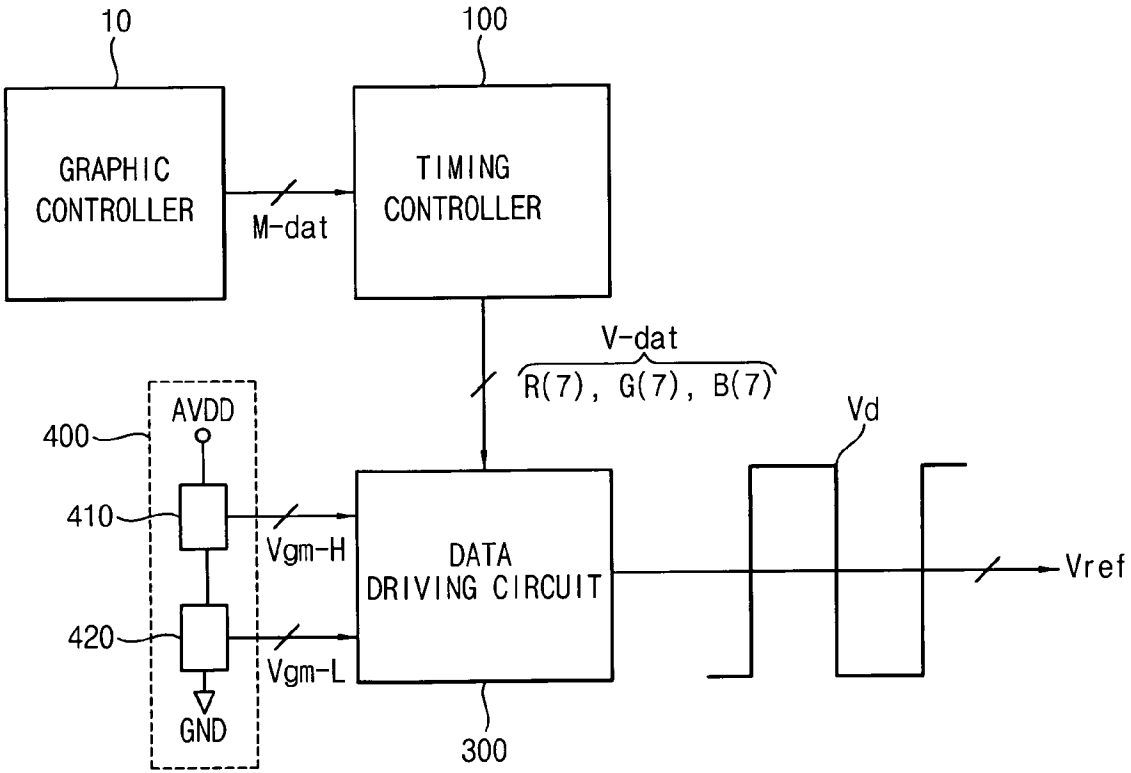
FIG. 2 is a block diagram for explaining outputting a data signal compensated for a kickback voltage.

FIG. 2 is a block diagram for explaining outputting a data signal compensated for a kickback voltage.

Referring to FIGS. 1 and 2, the processes of outputting a data signal compensated for a kickback voltage is explained more fully below.

The graphic controller 10 outputs the image control signal M-ctl to the timing controller 100. For example, the image control signal M-ctl includes an image data signal M-dat, a clock signal and various control signals.

The timing controller 100 compensates the image control signal M-dat for the kickback voltage to output a data control signal D-ctl to the data driving part 300. The data control signal D-ctl includes a voltage compensating data signal V-dat compensated for the kickback voltage. For example, the voltage compensating data signal V-dat may include red compensating data R(7), green compensating data G(7) and blue compensating data B(7), which are respectively composed of 7 bits.

The data driving part 300 is provided with the data control signal D-ctl by the timing controller 100, and is provided with the gamma voltages Vgm by the gamma voltage generating part 400. The data driving part 300 selects one of the gamma voltages Vgm corresponding to the voltage compensating data signal V-dat, and outputs the data signal Vd to the display panel 500.

The gamma voltage generating part 400 provides the data driving part 300 with the gamma voltages Vgm. The gamma voltages Vgm may include positive polarity gamma voltages Vgm-H higher than a reference voltage Vref and negative polarity gamma voltages Vgm-L lower than the reference voltage Vref. The gamma voltage generating part 400 may include a positive polarity string resistance part 410 to generate the positive polarity gamma voltages Vgm-H and a negative polarity string resistance part 420 to generate the negative polarity gamma voltages Vgm-L.

Thus, the data driving part 300 outputs a data signal Vd including the positive polarity gamma voltages Vgm-H and the negative polarity gamma voltages Vgm-L to the display panel 500 in response to the voltage compensating data signal V-dat.

Resistance values of the positive polarity string resistance part 410 may be symmetrical with respect to those of the negative polarity string resistance part 420. Alternatively, the resistance values of the positive polarity string resistance part 410 may not be symmetrical with respect to those of the negative polarity string resistance part 420. The positive polarity string resistance part 410 and the negative polarity string resistance part 420 may be connected to each other in series. Both ends of each of the positive and negative polarity string resistance parts 410 and 420 may be provided with a main direct current voltage AVDD and a ground voltage GND.

In an embodiment of the present invention, the voltage compensating data signal V-dat of the data control signal D-ctl has data corresponding to an entire range including a positive polarity and a negative polarity of the data signal Vd. Thus, the data control signal D-ctl controls the data driving part 200 to output the data signal Vd corresponding to the entire range including the positive polarity and the negative polarity of the data signal Vd.

A conventional data control signal further includes a polarity signal to identify whether a data signal has a positive polarity or a negative polarity. Thus, the conventional data control signal has data corresponding to the polarity of the data signal.

However, the data control signal D-ctl in an embodiment of the present invention has data corresponding to the entire range including the positive polarity and the negative polarity of the data signal Vd without the polarity signal and identifying the polarity of the data signal Vd.

Figure 3A:
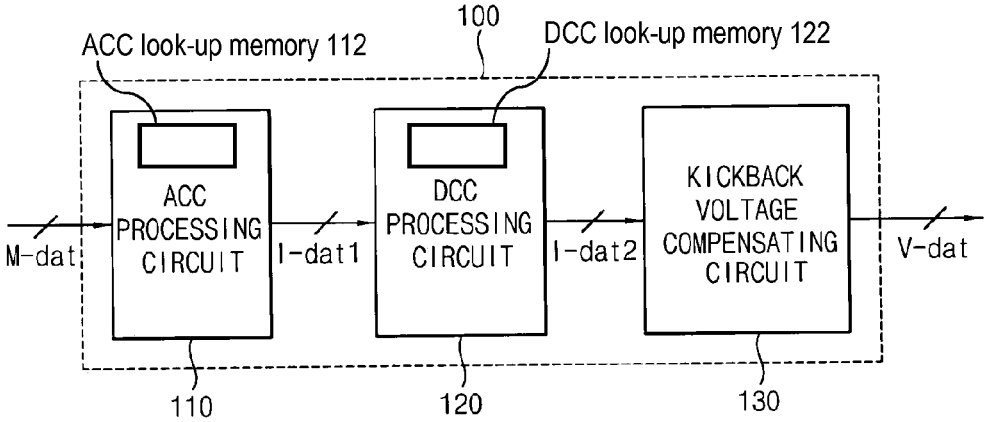
FIG. 3 is a block diagram illustrating in more detail the timing controller illustrated in FIG. 2.
Figure 3B:
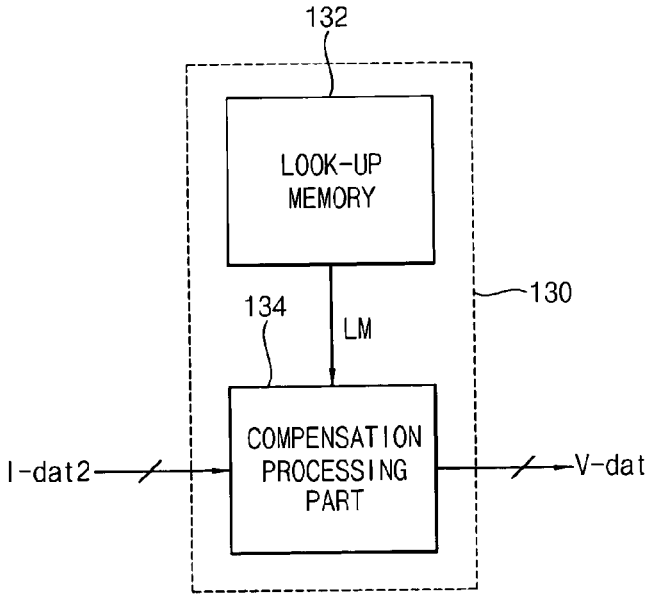

FIG. 3 is a block diagram illustrating a timing controller illustrated in FIG. 2.

Referring to FIGS. 2 and 3, the timing controller 100 may include, for example, an adaptive capacitance compensation (ACC) processing part 110, a dynamic capacitance compensation (DCC) processing part 120 and a kickback voltage compensating part 130.

The ACC processing part 110 is provided with the image data signal M-dat by the graphic controller 10, and processes the image data signal M-dat using ACC to output a first inside data signal I-dat1. The ACC processing part 110 may prevent color characteristics from being shifted based on variation of a gray scale value of data so that a color balance is maintained when the gray scale value varies.

For example, the ACC processing part 110 includes an ACC look-up memory 112 storing a correction value to maintain the color balance. Thus, the ACC processing part 110 processes the image data signal M-dat using the ACC look-up memory 112 to provide the DCC processing part 120 with the first inside data signal I-dat1.

The DCC processing part 120 is provided with the first inside data signal I-dat1 by the ACC processing part 110, and processes the first inside data signal I-dat1 using DCC to output a second inside data signal I-dat2. The DCC processing part 120 applies a voltage higher than an original voltage for one frame to rapidly drive a liquid crystal when a gray scale value of data varies.

For example, a DCC processing part 120 includes a DCC look-up memory 122 to compare data of a prior frame with data of a present frame and to determine an overshoot value. The DCC processing part 120 processes the first inside data signal I-dat1 using the DCC look-up memory 122 to provide the kickback voltage compensating part 130 with the second inside data signal I-dat2.

The kickback voltage compensating part 130 is provided with the second inside data signal I-dat2 by the DCC processing part 120, and compensates the second inside data signal I-dat2 for the kickback voltage to output the voltage compensating data signal V-dat. Therefore, the voltage compensating data signal V-dat may be defined as a digital signal generated compensating the second inside data signal I-dat2 for the kickback voltage.

For example, the kickback voltage compensating part 130 includes a kickback voltage look-up memory in which data corresponding to the kickback voltage is stored. The kickback voltage look-up memory changes the second inside data signal I-dat2 to output the voltage compensating data signal V-dat. The kickback voltage may have data varying based on a voltage level of the data signal. For example, the kickback voltage may have data symmetrical with respect to the common voltage Vcom of the display panel 500.

Figure 4:
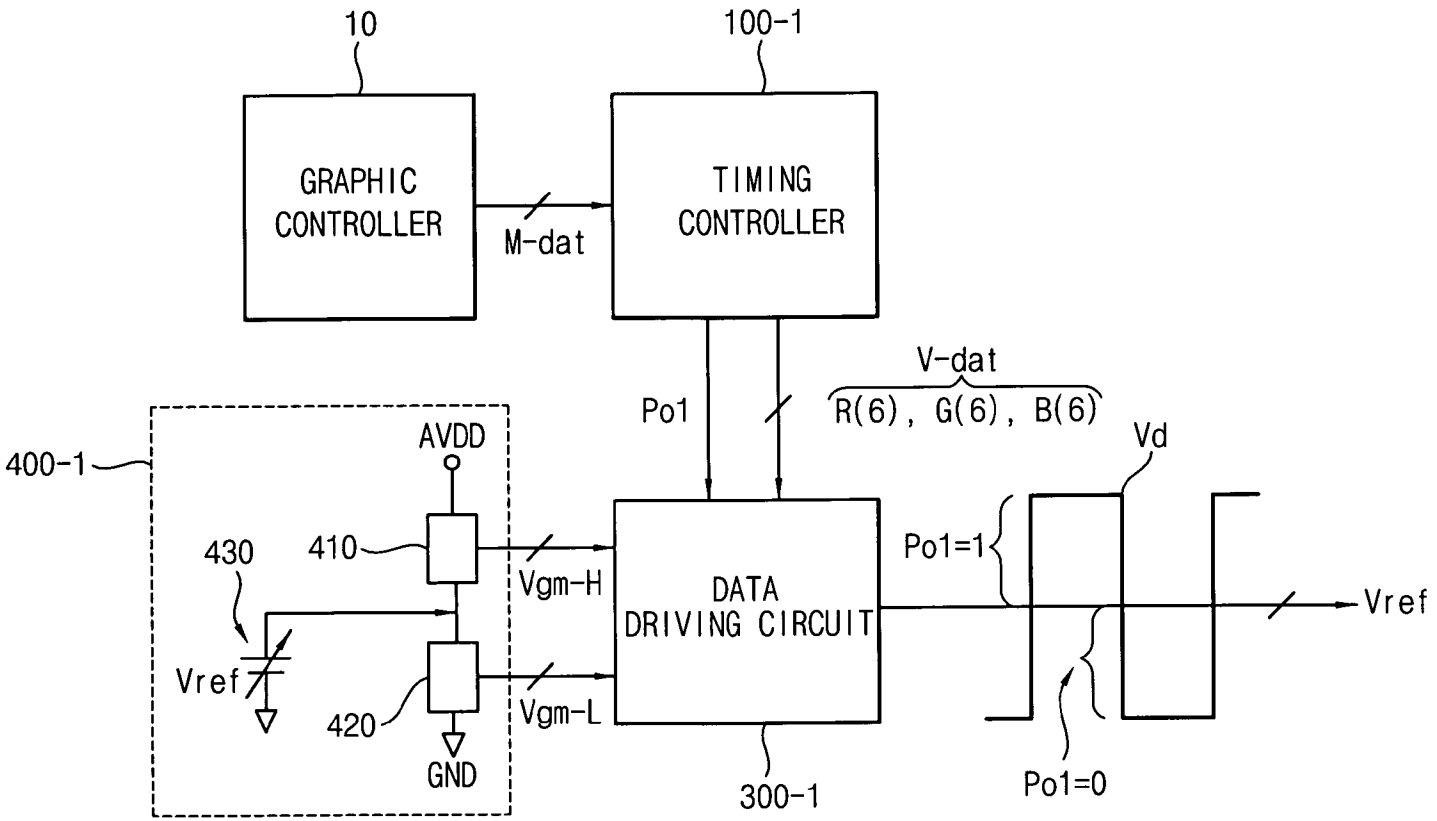
FIG. 4 is a block diagram of another embodiment of the present invention.

FIG. 4 is a block diagram illustrating another embodiment of the present invention.

Processes of outputting a data signal, which are different from the processes illustrated in FIG. 2 will be described referring to FIGS. 1 and 4.

The graphic controller 10 outputs the image data signal M-dat to the timing controller 100-1.

The timing controller 100-1 compensates the image data signal M-dat for the kickback voltage to output the data control signal D-ctl to the data driving circuit 300. The data control signal D-ctl includes a polarity selecting signal Pol to select one of a positive polarity and a negative polarity of the data signal Vd and a voltage-compensating data signal V-dat compensating the image data signal M-dat for the kickback voltage.

For example, when the polarity selecting signal Pol has a digital value of '1', the data signal Vd has a voltage corresponding to the positive polarity. When the polarity selecting signal Pol has a digital value of '0', the data signal Vd has a voltage corresponding to the negative polarity. The voltage-compensating data signal V-dat includes data corresponding to the polarity selected by the polarity selecting signal Pol. For example, the voltage-compensating data signal V-dat may include red compensating data R(6), green compensating data G(6) and blue compensating data B(6), which are respectively composed of 6 bits.

The data driving part 300 is provided with the polarity selecting signal Pol and the voltage-compensating data signal V-dat by the timing controller 100, and with the gamma voltages Vgm by the gamma voltage generating part 400 to output the data signal Vd to the display panel 500. The polarity selecting signal Pol determines the polarity of the data signal Vd, and the voltage-compensating data signal V-dat determines the substantial voltage value of the data signal Vd in a range corresponding to the polarity.

The gamma voltage generating part 400 provides the data driving part 300 with the gamma voltages Vgm. The gamma voltage generating part 400 may include a positive polarity string resistance part 410, a negative polarity string resistance part 420 and a reference voltage generating part 430.

The positive polarity string resistance part 410 generates positive polarity gamma voltages Vgm-H higher than a reference voltage Vref to provide the data driving part 300 with the positive polarity gamma voltages Vgm-H. The negative polarity string resistance part 420 generates negative polarity gamma voltages Vgm-L lower than the reference voltage Vref to provide the data driving part 300 with the negative polarity gamma voltages Vgm-L. The reference voltage generating part 430 generates the reference voltage Vref varying based on the kickback voltage. The reference voltage Vref may have a voltage value greater than the common voltage of the display panel 500 since the pixel voltage of the display panel 500 is reduced by the kickback voltage due to the gray scale.

Resistance values of the positive polarity string resistance part 410 may be symmetrical with respect to those of the negative polarity string resistance part 420. Alternatively, the resistance values of the positive polarity string resistance part 410 may not be symmetrical with respect to those of the negative polarity string resistance part 420.

The positive polarity string resistance part 410 and the negative polarity string resistance part 420 may be connected to each other in series. Both ends of each of the positive and negative polarity string resistance parts 410 and 420 may be provided with a main direct current voltage AVDD and a ground voltage GND. The reference voltage Vref may be applied to between the positive polarity string resistance part 410 and the negative polarity string resistance part 420 by the reference voltage generating part 430.

Thus, the data driving part 300 outputs the data signal Vd to the display panel in response to the polarity selecting signal Pol and the voltage compensating data signal V-dat. The data signal Vd includes the positive polarity gamma voltages Vgm-H and the negative polarity gamma voltages Vgm-L.

Figure 5:
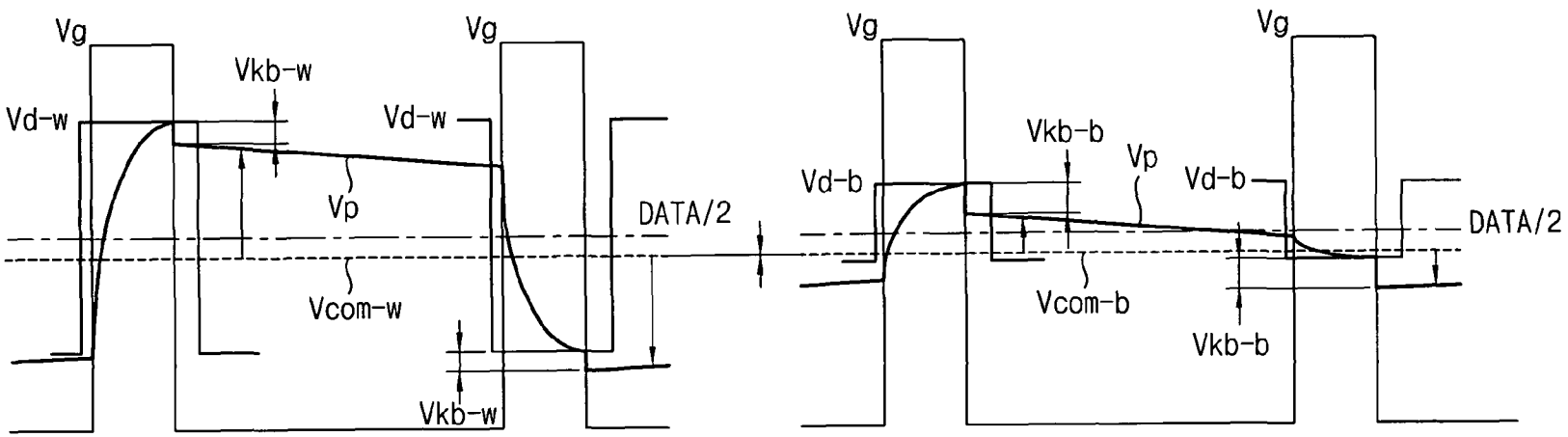
FIGS. 5 and 6 are waveform diagrams illustrating a common voltage in a white gray scale and a common voltage in a black gray scale having substantially the same voltage values.
Figure 6:
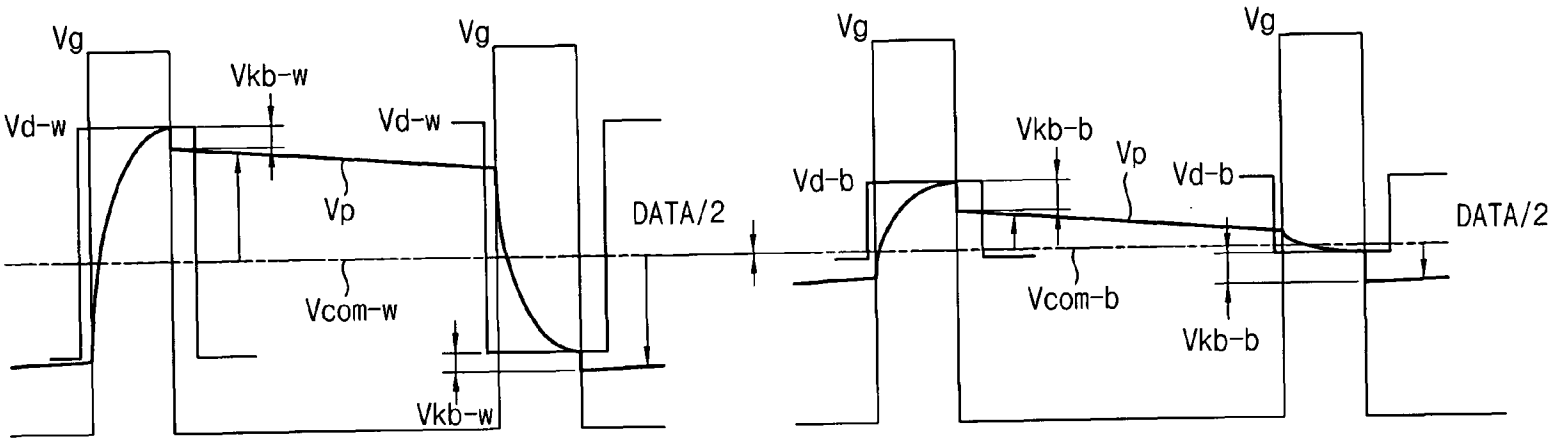

FIGS. 5 and 6 are waveform diagrams for illustrating a common voltage in a white gray scale and a common voltage in a black gray scale having substantially the same voltage values.

Referring to FIGS. 1, 5 and 6, when a data line DL is provided with a data signal Vd previously compensated for a kickback voltage corresponding to a reduced voltage value of a pixel voltage Vp, a white common voltage Vcom-w for a white image and a black common voltage Vcom-b for a black image may have substantially the same voltage values.

Figure 7:
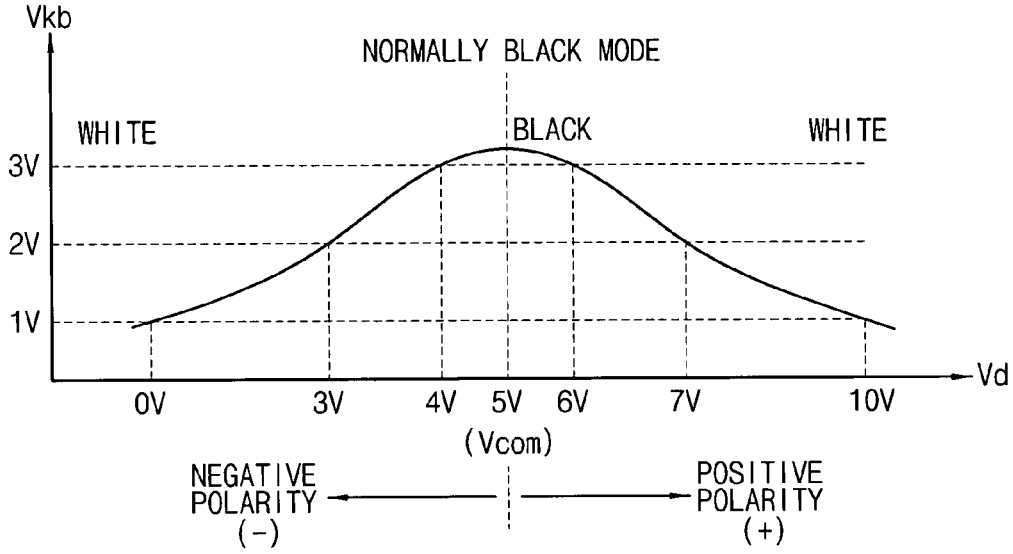
FIG. 7 shows a curve which illustrates kickback voltage varying based on levels of data signals of FIGS. 2 and 4.

Referring to FIG. 6, the white common voltage Vcom-w and the black common voltage Vcom-b have substantially the same voltage values as a common voltage Vcom of an arbitrary gray scale. Referring to FIG. 7, the white common voltage Vcom-w and the black common voltage Vcom-b have substantially the same voltage values as an intermediate data voltage Data/2. The intermediate data voltage Data/2 has a voltage value halfway between the positive polarity and the negative polarity.

For example, when the data line DL is provided with a white data signal Vd-w corresponding to a white gray scale and compensated for a white kickback voltage Vkb-w, and when the gate signal Vg rises, the pixel electrode is charged with the pixel voltage Vp by the white data signal Vd-w.

Furthermore, when the gate signal Vg falls, the pixel voltage Vp is reduced by the white kickback voltage Vkb-w.

For example, when the data line DL is provided with a black data signal Vd-b corresponding to a black gray scale and compensated for a black kickback voltage Vkb-b, and when the gate signal Vg rises, the pixel electrode is charged with the pixel voltage Vp by the black data signal Vd-b. Furthermore, when the gate signal Vg falls, the pixel voltage Vp is reduced by the black kickback voltage Vkb-b.

A voltage value of the white kickback voltage Vkb-w is different from that of the black kickback voltage Vkb-b. However, the white common voltage Vcom-w and the black common voltage Vcom-b have substantially the same voltage values since the white data signal Vd-w and the black data signal Vd-b are respectively compensated for the white kickback voltage Vkb-w and the black kickback voltage Vkb-b. Thus, the embodiment of the present invention may prevent and/or reduce flicker defects due to a difference between the white common voltage Vcom-w and the black common voltage Vcom-b.

FIG. 7 shows a curve which illustrates kickback voltage Vkb varying based on levels of data signals Vd of FIGS. 2 and 4.

Referring to FIGS. 1 and 7, a voltage value of the kickback voltage Vkb varies based on the data signal Vd. For example, the kickback voltage Vkb may have voltage values symmetrical with respect to the common voltage Vcom.

For example, when the display panel 500 displays an image according to a normally black mode, the kickback voltage Vkb may have a relatively low voltage value in a white gray scale and may have a relatively high voltage value in a black gray scale. The voltage values of the kickback voltage Vkb may be symmetrical with respect to the common voltage Vcom.

The voltage values in FIG. 7 are exemplary voltage values arbitrarily selected for explaining an embodiment of the present invention.

Figure 8A:
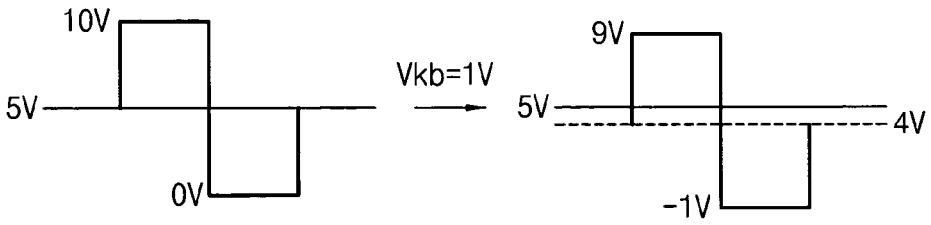
FIGS. 8A, 8B and 8C are waveform diagrams illustrating variation when a pixel voltage is not being compensated for the kickback voltage of FIG. 7.
Figure 8B:
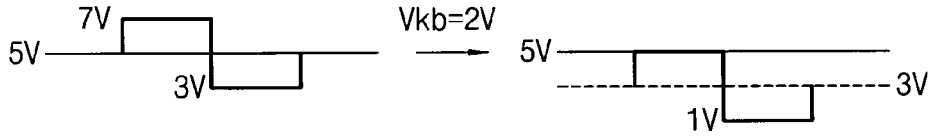
Figure 8C:
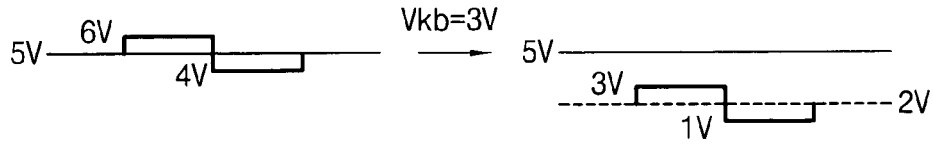

FIGS. 8A, 8B and 8C are waveform diagrams illustrating variation when a pixel voltage is not being compensated for the kickback voltage of FIG. 7. Particularly, FIGS. 8A, 8B and 8C illustrate variation of the pixel voltage generated by a data signal which is not compensated for the kickback voltage.

Referring to FIGS. 1, 7 and 8A, a data signal Vd having voltage values of about 10 V and about 0 V with respect to a common voltage Vcom of about 5 V is reduced by a kickback voltage Vkb of about 1 V. Thus, a pixel voltage charged in the pixel electrode has voltage values of about 9 V and about −1 V with respect to a common voltage Vcom of about 4 V.

Referring to FIGS. 1, 7 and 8B, a data signal Vd having voltage values of about 7 V and about 3 V with respect to a common voltage Vcom of about 5 V is reduced by a kickback voltage Vkb of about 2 V. Thus, a pixel voltage charged in the pixel electrode has voltage values of about 5 V and about 1 V with respect to a common voltage Vcom of about 3 V.

Referring to FIGS. 1, 7 and 8C, a data signal Vd having voltage values of about 6 V and about 4 V with respect to a common voltage Vcom of about 5 V is reduced by a kickback voltage Vkb of about 3 V. Thus, a pixel voltage charged in the pixel electrode has voltage values of about 3 V and about 1 V with respect to a common voltage Vcom of about 2 V.

Figure 9A:
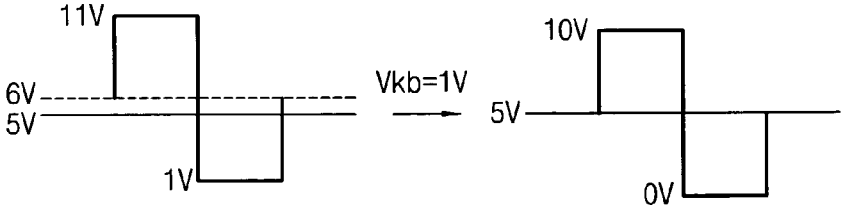
FIGS. 9A, 9B and 9C are waveform diagrams illustrating variation of a pixel voltage that has previously been compensated for the kickback voltage of FIG. 7.
Figure 9B:
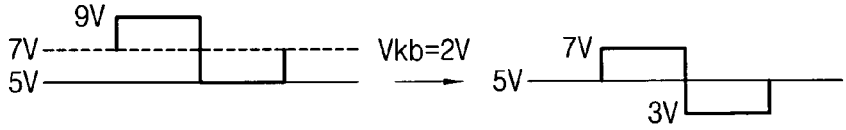
Figure 9C:
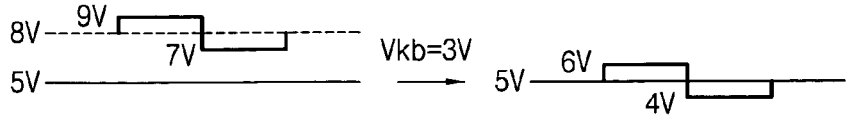

FIGS. 9A, 9B and 9C are waveform diagrams illustrating variation of a pixel voltage that has previously been compensated for the kickback voltage of FIG. 7. Particularly, FIGS. 9A, 9B and 9C illustrate variation of the pixel voltage generated by a data signal previously compensated for the kickback voltage.

Referring to FIGS. 1, 7 and 9A, a data signal Vd having voltage values of about 11 V and about 1 V with respect to a common voltage Vcom of about 6 V is reduced by a kickback voltage Vkb of about 1 V. Thus, a pixel voltage charged in the pixel electrode has voltage values of about 10 V and about 5 V with respect to a common voltage Vcom of about 5 V.

Referring to FIGS. 1, 7 and 9B, a data signal Vd having voltage values of about 9 V and about 5 V with respect to a common voltage Vcom of about 7 V is reduced by a kickback voltage Vkb of about 2 V. Thus, a pixel voltage charged in the pixel electrode has voltage values of about 7 V and about 3 V with respect to a common voltage Vcom of about 5 V.

Referring to FIGS. 1, 7 and 9C, a data signal Vd having voltage values of about 9 V and about 7 V with respect to a common voltage Vcom of about 8 V is reduced by a kickback voltage Vkb of about 3 V. Thus, a pixel voltage charged in the pixel electrode has voltage values of about 6 V and about 4 V with respect to a common voltage Vcom of about 5 V.

The data signal Vd of FIG. 9A have voltage values corresponding to both a positive polarity and a negative polarity with respect to the common voltage Vcom of about 5 V. The data signals Vd of FIGS. 9B and 9C have voltage values corresponding to a positive polarity with respect to the common voltage Vcom of about 5 V.

Thus, when a reference voltage determining the polarity of the data signal Vd is varied to correspond to the kickback voltage Vkb, the data signal Vd previously compensated for the kickback voltage Vkb may have voltage values corresponding to both the positive polarity and the negative polarity with respect to the reference voltage. The reference voltage may have a voltage value higher than the common voltage Vcom of about 5 V by the kickback voltage Vkb.

In an embodiment of the present invention, the data driving part 300 is provided with the data control signal D-ctl generated compensating the image control signal M-ctl for the kickback voltage Vkb. Thus, flicker defects due to a common voltage that is not optimized may be reduced and/or prevented.

Moreover, when the flicker defects may be prevented and/or reduced by the data control signal D-ctl compensated for the kickback voltage Vkb, the storage line overlapped with the pixel electrode may be removed and/or lessened. When the storage line is removed and/or lessened, the light transmittance of a pixel unit may be improved.

Hereinafter, a method of driving the display device according an embodiment of the present invention will be described more fully with reference to FIGS. 1, 2 and 4.

The display device 600 is externally provided with the image control signal M-ctl. Particularly, the timing controller 100 of the display device 600 is provided with the image control signal M-ctl including the image data signal M-dat.

The timing controller 100 outputs the gate control signal G-ctl to the data driving part 200 and the data control signal D-ctl to the data driving part 300 in response to the image control signal M-ctl. The data control signal D-ctl is previously compensated for the kickback voltage Vkb. The pixel voltage is reduced by the kickback voltage Vkb when the gate signal Vg falls.

The gate driving part 200 outputs the gate signal Vg to the display panel 500 in response to the gate control signal G-ctl, and the data driving part 300 outputs the data signal Vd to the display panel 500 in response to the data control signal D-ctl.

The display panel 500 displays an image in response to the gate signal Vg and the data signal Vd.

The data control signal D-ctl may have data corresponding to an entire range corresponding to both a positive polarity and a negative polarity of the data signal Vd.

Alternatively, the data control signal D-ctl may have a polarity selecting signal and a data driving signal having data values in a range of the selected polarity. A reference voltage determining the polarity of the data signal Vd may be varied based on the kickback voltage. For example, the reference voltage may be varied to have a voltage value greater than a common voltage Vcom of the display panel 500.

According to the above, a data driving part is provided with a data control signal generated compensating an image control signal for a kickback voltage to display an image. Thus, flicker defects due to a common voltage that is not optimized may be reduced and/or prevented.

Furthermore, when the flicker defects are prevented and/or reduced by the data control signal compensated for the kickback voltage, a storage line overlapped with a pixel electrode may be removed and/or lessened. Thus, the light transmittance of a pixel unit may be improved.

Although the embodiments of the present invention have been described, it is understood that the present invention should not be limited to these embodiments but various changes and modifications can be made by one ordinary skilled in the art within the spirit and scope of the present invention as hereinafter claimed.

What is claimed is:

1. A display device comprising:

a timing controller adapted to receive image control signals and in response thereto generate gate control signals and data control signals;

a gate driving circuit coupled to the timing controller, the gate driving circuit being adapted to generate gate signals;

a data driving circuit coupled to the timing controller, the data driving circuit being adapted to generate data signals;

a display panel adapted to display an image in response to the gate signals and the data signals, wherein the timing controller includes a kickback voltage compensation circuit adapted to compensate at least a data signal related to the image control signals for a kickback voltage to output a compensated data control signal to the data driving circuit, the kickback voltage compensating circuit including a kickback voltage look-up memory for storing kickback voltage values of the kickback voltage in relation to data signal values of the data signal that are to be compensated using the kickback voltage values, and wherein the kickback voltage look-up memory associates two data signal values of the signal values of the data signal that are substantially symmetrical with respect to a common voltage of the display panel with a same kickback voltage value among the kickback voltage values for indicating that the two data signal values are to be compensated using the same kickback voltage value.

2. The display device according to claim 1, wherein a compensation of the kickback compensation circuit is varied based on a received gray scale voltage.

3. The display device of claim 1, wherein the data control signal has data corresponding to an entire range including a positive polarity and a negative polarity of the data signals.

4. The display device of claim 1, further comprising a gamma voltage generating circuit coupled to the data driving circuit, the gamma voltage generating circuit being operative to generate a plurality of gamma voltages.

5. The display device of claim 4, wherein the gamma voltage generating circuit comprises:

a positive polarity string resistance part to generate positive polarity gamma voltages higher than a reference voltage; and a negative polarity string resistance part to generate negative polarity gamma voltages lower than a reference voltage.

6. The display device of claim 5, wherein the gamma voltage generating circuit further comprises a reference voltage generating circuit operative to generate a reference voltage having a magnitude varied based on a magnitude of the kickback voltage.

7. The display device of claim 6, wherein the reference voltage has a voltage value greater than the common voltage of the display panel.

8. The display device of claim 5, wherein a resistance value of the positive polarity string resistance part and a resistance value of the negative polarity string resistance part are substantially asymmetrical with each other.

9. The display device of claim 1, wherein the data control signals comprise:

a polarity selecting signal to select one of a positive polarity and a negative polarity of the data signal; and a data driving signal having data in a range of the selected polarity.

10. The display device of claim 1, wherein the timing controller further includes a first processing part for processing the image control signals to generate a first inside data signal, and the timing controller further includes a second processing part, the second processing part including a first look-up memory for comparing data of a prior frame with data of a present frame to determine an overshoot value, the second processing part using the first look-up memory in processing the first inside data signal to generate a second inside data signal.

11. The display device of claim 10, wherein the kickback voltage compensation circuit compensates the second inside data signal for the kickback voltage to output the compensated data control signal to the data driving circuit.

12. The display device of claim 10, wherein the first processing part includes a second look-up memory, the second look-up memory storing a correction value to maintain a color balance, the first processing part using the second look-up memory in processing the image control signals to generate the first inside data signal.

13. The display device of claim 1, wherein the kickback voltage look-up memory has data varying based on a level of the compensated data control signal.

14. The display device of claim 1, wherein the timing controller controls a gate driver that includes the gate driving circuit and a data driver that includes the data driving circuit.

15. The display device of claim 1, wherein the display panel comprises:

an array substrate provided with the gate signal and the data signal; an opposing substrate facing the array substrate; and a liquid crystal layer interposed between the array substrate and the opposing substrate.

16. The display device of claim 15, wherein the array substrate comprises:

a gate line;

a data line;

a thin-film transistor (TFT) connected to the gate line and the data line; and a pixel electrode connected to the TFT and charged with the pixel voltage.

17. A method of driving a display device, in which a pixel voltage is reduced by a kickback voltage varied based on a gray scale, the method comprising:

receiving an image control signal from an external source;

compensating, using a kickback voltage look-up memory, at least a data signal related to the image control signal for the kickback voltage to generate a data control signal, the kickback voltage look-up memory storing kickback voltage values of the kickback voltage in relation to data signal values of the data signal that are to be compensated using the kickback voltage values, wherein according to the look-up memory two data signal values of the data signal values of the data signal that are substantially symmetrical with respect to a common voltage of a display panel correspond to a same kickback voltage value among the kickback voltage values and are to be compensated using the same kickback voltage value; and displaying, using the display panel, an image in response to the data control signal.

18. The method of claim 17, wherein the data control signal has data corresponding to an entire range including a positive polarity and a negative polarity of data signals generated by a data driving circuit.

19. The method of claim 17, further comprising varying a reference voltage based on the kickback voltage, the reference voltage determining a polarity of a gamma voltage of the display device.

20. The method of claim 19, wherein the varied reference voltage has a voltage value greater than the common voltage of the display panel.

* * * * *